US011000098B2

(12) United States Patent
Fogg et al.

(10) Patent No.: US 11,000,098 B2
(45) Date of Patent: May 11, 2021

(54) FOOTWEAR WITH DYNAMIC STRAP SYSTEM

(71) Applicant: Wolverine Outdoors, Inc., Rockford, MI (US)

(72) Inventors: Peter Fogg, Lake Oswego, OR (US); Andrew Estey, Grand Rapids, MI (US); Omar Velazquez, Grand Rapids, MI (US)

(73) Assignee: Wolverine Outdoors, Inc., Rockford, MI (US)

( * ) Notice: Subject to any disclaimer, the term of this patent is extended or adjusted under 35 U.S.C. 154(b) by 85 days.

(21) Appl. No.: 16/179,313

(22) Filed: Nov. 2, 2018

(65) Prior Publication Data

US 2020/0138147 A1 May 7, 2020

(51) Int. Cl.
*A43C 11/14* (2006.01)
*A43C 11/08* (2006.01)
*A43C 11/24* (2006.01)

(52) U.S. Cl.
CPC ..... *A43C 11/14* (2013.01); *A43C 11/08* (2013.01); *A43C 11/24* (2013.01)

(58) Field of Classification Search
CPC ..... A43B 7/144; A43B 7/148; A43B 13/12; A43B 13/125; A43B 21/26; A43C 11/08; A43C 11/24
USPC ..... 36/107, 108, 76 R, 35 R, 37
See application file for complete search history.

(56) References Cited

U.S. PATENT DOCUMENTS 2,112,884 A * 4/1938 Gillette ..... A43B 3/126 36/11.5
4,080,745 A * 3/1978 Torrance ..... A43B 5/001 36/127
4,446,633 A * 5/1984 Scheinhaus ..... A43B 3/126 36/11.5
4,813,162 A * 3/1989 Harris ..... A43B 3/108 36/11.5
4,817,302 A * 4/1989 Saltsman ..... A43B 3/122 36/11.5
4,843,736 A * 7/1989 Courian ..... A43B 3/105 36/11.5
5,205,054 A * 4/1993 York, Jr. ..... A43B 3/126 36/11.5
5,454,382 A * 10/1995 Tariah ..... A43B 3/105 128/882
5,819,439 A * 10/1998 Sanchez ..... A43C 11/14 36/89

(Continued)

OTHER PUBLICATIONS

Chaco Z-Sandal Collection website downloaded from https://www.chacos.com/US/en/z-sandal-collection/?CID=SEM-Search_Brand_Phrase_Chaco_G_Core-chaco&gclid=EAIaIQobChMI8-Lgp4nv3QIVQZ7ACh1SGwFsEAAYASAAEgLItfD_BwE&gclsrc=aw.ds on Oct. 5, 2018.

(Continued)

*Primary Examiner* — Sharon M Prange
*Assistant Examiner* — Erick I Lopez
(74) *Attorney, Agent, or Firm* — Warner Norcross + Judd LLP

(57) ABSTRACT

A footwear construction is provided including an upper joined with a sole assembly having a dynamic strap system that extends over the upper to secure the footwear on a wearer's foot. The sole assembly includes strap channels for the strap system, which can be free-floating relative to at least a portion of the exterior surface of the upper, and a foxing band encircling a substantial portion of the upper.

20 Claims, 6 Drawing Sheets

(56) References Cited

U.S. PATENT DOCUMENTS

| | | | | |
|---|---|---|---|---|
| 6,270,468 | B1 | 8/2001 | Townsend et al. | |
| D476,469 | S | 7/2003 | Belley et al. | |
| D530,490 | S | 10/2006 | Sonnergren | |
| D541,519 | S | 5/2007 | Belley et al. | |
| D549,934 | S | 9/2007 | Horne et al. | |
| D549,935 | S | 9/2007 | Schoenborn et al. | |
| D549,936 | S | 9/2007 | Matis et al. | |
| D551,435 | S | 9/2007 | Belley et al. | |
| D560,887 | S | 2/2008 | Belley | |
| D561,438 | S | 2/2008 | Belley | |
| D561,986 | S | 2/2008 | Horne et al. | |
| D569,594 | S | 5/2008 | Horne et al. | |
| 7,823,299 | B1 * | 11/2010 | Brigham | A43B 3/105 36/101 |
| 7,930,841 | B2 * | 4/2011 | Luedecke | A43B 5/08 36/113 |
| D665,981 | S | 8/2012 | Hill et al. | |
| 8,333,022 | B2 | 12/2012 | Crowley, II et al. | |
| 9,167,868 | B1 * | 10/2015 | Koo | A43C 1/00 |
| D755,491 | S | 5/2016 | Nakano | |
| D756,095 | S | 5/2016 | Nakano | |
| 2002/0148142 | A1 * | 10/2002 | Oorei | A43C 1/00 36/129 |
| 2003/0074806 | A1 * | 4/2003 | Urie | A43B 3/126 36/11.5 |
| 2004/0128863 | A1 * | 7/2004 | Hong | A43B 3/242 36/100 |
| 2008/0307670 | A1 * | 12/2008 | Duclos | A43B 9/04 36/4 |
| 2009/0071041 | A1 * | 3/2009 | Hooper | A43B 23/0245 36/3 A |
| 2011/0179674 | A1 * | 7/2011 | Heid | A43C 11/1493 36/91 |
| 2011/0258876 | A1 * | 10/2011 | Baker | A43C 11/1493 36/50.1 |
| 2015/0089839 | A1 * | 4/2015 | James | A43B 11/00 36/102 |
| 2016/0128424 | A1 * | 5/2016 | Connell | A43B 23/0265 36/103 |
| 2019/0335847 | A1 * | 11/2019 | Soderqvist | A43B 13/02 |
| 2019/0350304 | A1 * | 11/2019 | Velazquez | A43B 5/00 |

OTHER PUBLICATIONS

SanKuanz's Strap-On Sneaker Protector downloaded from https://www.designboom.com/design/sankuanz-shoes-sneaker-protector-sandal-paris-mens-fashion-week-01-31-2018/ on Oct. 5, 2018.
CAT Footwear 1997 Catalog, p. 37.
Merrell Sandals Spring, Summer 1996, p. 4.
Hy-Test 1998 Catalog, p. 69.
Merrell Performance Footwear Spring 2000 Catalog, p. 41.
Harley Davidson 2000 Catalog, p. 33.
Bates 2007 Catalog, p. 20.
Wolverine 2000 Catalog, Rubber Section, p. 1.
CAT Footwear 2008 Catalog, pp. 10, 11.
U.S. Department of Homeland Security, U.S. Customs and Border Protection, What Every Member of the Trade Community Should Know About: Footwear, An Informed Compliance Publication, Apr. 2012.
Harmonized Tariff Schedule of the United States (2018) Revision 13, Section XII: Footwear, Headgear, Umbrellas, Sun Umbrellas, Walking-Sticks, Seat-Sticks, Whips, Riding-Crops and Parts Thereof; Prepared Feathers and Articles Made Therewith; Artificial Flowers; Articles of Human Hair, pp. 1-46.

* cited by examiner

FOOTWEAR WITH DYNAMIC STRAP SYSTEM

BACKGROUND OF THE INVENTION

The present invention relates to footwear, and more particularly to footwear having an upper and a dynamic strap system.

There are a variety of different types of footwear that serve different functions. One type of footwear is a sandal. A sandal usually has a sole from which multiple straps project to secure a wearer's foot to the sole. Most sandals are relatively open so as to expose the wearer's foot to the environment. This can provide improved cooling as well as rapid drying of the wearer's foot in watery environments.

The straps of most sandals are configured to wrap up and over a wearer's foot. A popular and aesthetically unique type of strap system is that of the Chaco Z Classic Sandal, available from Wolverine World Wide of Rockford, Mich. This strap system has straps that wrap around a user's foot in the ankle and the forefoot to hold the sandal to the wearer's foot. While primarily aesthetic, this strap system is rather efficient, and secures well the outsole to the wearer's foot. The strap system also can move with the wearer's foot depending on the gait cycle of the wearer. The straps can also prevent the sole assembly from moving around relative to the wearer's foot. Thus, the top of the sole assembly can be relatively flat, with the straps simply projecting up from that top surface to constrain the wearer's foot atop that flat surface.

Of course, sandals are not the only type of footwear. Other common footwear are closed upper footwear that include a leather or fabric upper secured to a sole assembly. The upper forms a closed void within which the wearer's foot can be disposed. In these constructions, the upper usually is fixedly glued to the sole assembly. Thus, the upper does not move around very freely to allow the wearer's foot to do the same, so the foot remains rather constrained in the void.

Accordingly, there remains room for improvement in the field of sandals and other footwear to enhance comfort and movement of a wearer's foot.

SUMMARY OF THE INVENTION

Footwear is provided including an upper joined with a sole assembly having a dynamic strap system that extends over the upper to secure the footwear on a wearer's foot.

In one embodiment, the sole assembly can include a base defining a foot-shaped perimeter. Lateral and medial sidewalls can extend upward from the base. The lateral sidewall can define a first lateral strap channel, and the medial sidewall opposite the lateral sidewall can define a first medial strap channel. The base, lateral sidewall, and medial sidewall can form a downwardly-extending foot cradle below an uppermost rim.

In another embodiment, a strap can be slidably disposed in the first lateral strap channel and the first medial strap channel. The strap can extend over an exterior surface of the upper, transitioning from lateral to medial sides of the upper. The strap can be free-floating relative to at least a portion of the exterior surface of the upper, and optionally can be cinched down to better secure the upper to a wearer's foot.

In another embodiment, the sole assembly can include a heel wall extending upward from the base. The heel wall can be contiguous with the lateral sidewall and the medial sidewall. The heel wall, lateral sidewall, and the medial sidewall can form at least a portion of a foxing-like band, also referred to herein as a foxing band, that encircles at least 60% of the foot-shaped perimeter.

In another embodiment, the foxing band can terminate at an upper rim disposed a distance of at least ¼ inch from the base, or alternatively at least ⅜ inch from the base.

In still another embodiment, the sole assembly can include a base defining a foot-shaped perimeter and a foxing band extending upward from the base to define a foot cradle. The foxing band can encircle at least 60% of the foot-shaped perimeter. The foxing band can terminate at an upper rim disposed a distance of at least ¼ inch or ⅜ inch from the base.

In a further embodiment, the foxing band can define a first medial strap channel and a first lateral strap channel. A strap can be slidably disposed in the same and can extend upward and over an exterior surface of an upper.

In yet another embodiment, the foxing band or other walls of the sole assembly can include an interior channel wall having an interior wall thickness. A strap can extend from at least one of the strap channels upward along the exterior surface of the upper. The strap can be held away from the upper near the upper rim of the sole assembly to promote movement. For example, the strap can be disposed at least the interior wall thickness away from the exterior surface for a first distance. The strap can contact the exterior surface beyond the first distance, and can slide over the exterior surface.

In even another embodiment, the sole assembly can form a deep cradle for the user's foot. The cradle can include the strap channels that extend upward adjacent the sides of the wearer's foot. This can guide the straps laterally outward from the foot and provide extra lateral stability.

In still another embodiment, the strap channels can form channel boxes that protrude from the exterior surface of the sole assembly. The channel boxes can be separated from one another by predetermined distances. The straps can be channeled by these boxes and/or by the walls of the sole assembly. By using the protruding channel boxes, rather than an extremely thick sidewall, the weight of the sole assembly is reduced.

In a further embodiment, the sole assembly can include a rock plate adjacent an outsole in predetermined areas. The rock plate can render the sole assembly more rigid, and can prevent the wearer from feeling sharp rocks or objects underfoot.

The footwear of the current embodiments provides an upper, sole assembly and strap system that secure exceptionally well to a wearer's foot to provide enhanced stability and comfort. Where the foxing band or walls cooperatively form a deep cradle, the sole assembly can provide a comfortable area within which the foot is solidly planted. The straps extending up and over portions of the exterior surface of the upper can provide both a unique appearance as well as better secure the sole assembly to the wearer's foot. In cases where the strap channels are disposed laterally outward from the upper adjacent the upper rim of the sole assembly, the straps likewise can be held away from the wearer's foot to prevent strap pinch. Further, with the straps being free-floating over the upper and under the footbed, the straps can encircle and dynamically tighten around the wearer's foot. Where the walls or foxing band include the protruding channel boxes, the weight of the sole can be greatly reduced.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
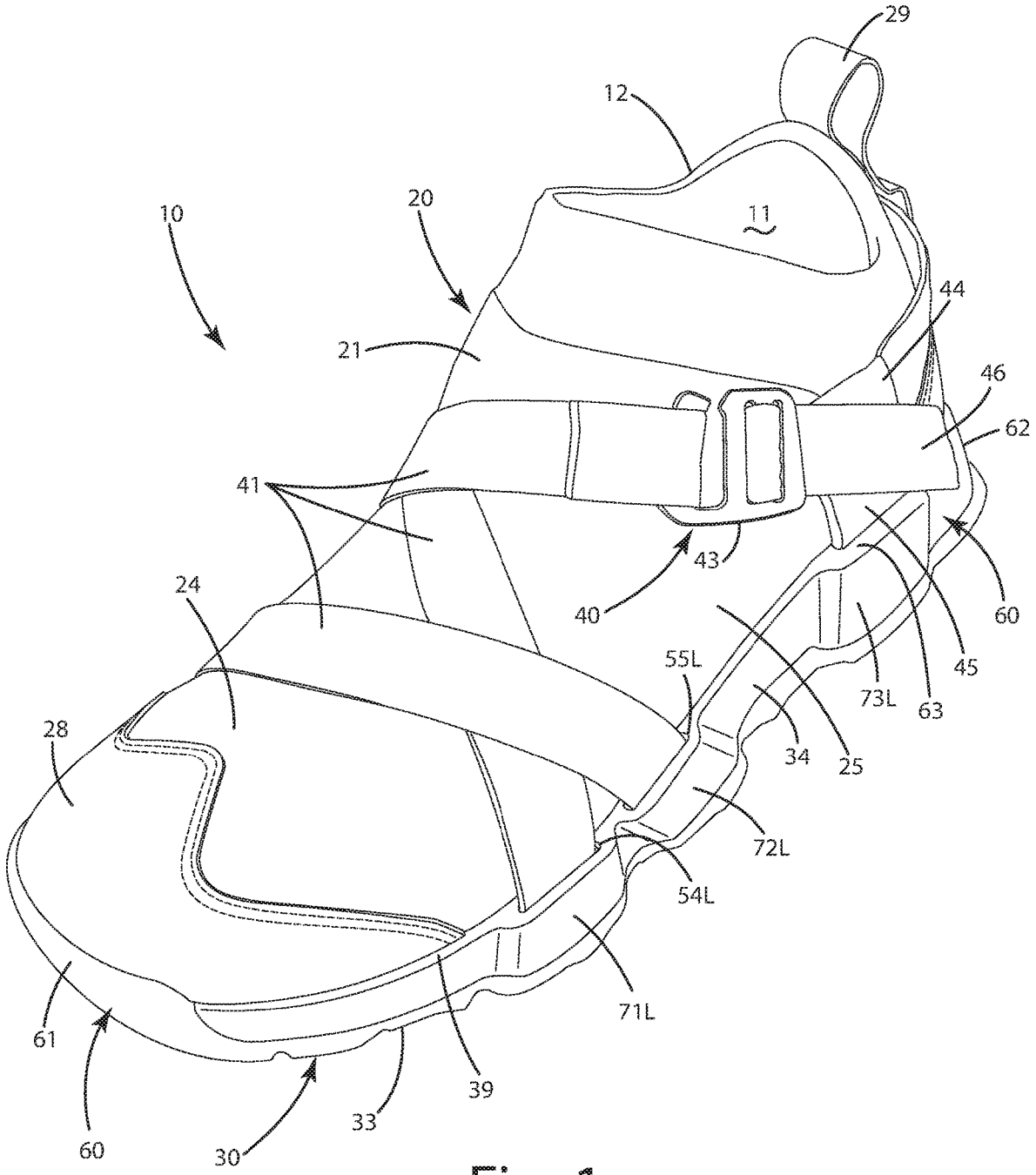
FIG. 1 is a perspective side view of a footwear of a current embodiment illustrating a sole assembly and an integrated strap system over an upper.

A current embodiment of the footwear is illustrated in FIGS. 1-9, and generally designated 10. This footwear 10 generally includes an upper 20 joined with a sole assembly 30 having a dynamic strap system 40 that extends over the upper 20 to secure the footwear 10 on a wearer's foot. The footwear 10 includes a foot void 11, defined by the upper 20 and sole assembly 30, configured to securely and comfortably hold a human foot. The foot is received through a foot opening 12 defined by the upper 20.

Although the current embodiments are illustrated in the context of a winter boot or water resistant shoe, they may be incorporated into any type or style of footwear, including performance shoes, hiking shoes, trail shoes and boots, hiking boots, work boots, all-terrain shoes, barefoot running shoes, athletic shoes, running shoes, sneakers, conventional tennis shoes, walking shoes, multisport footwear, casual shoes, dress shoes or any other type of footwear or footwear components. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations.

Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe. The use of directional terms should not be interpreted to limit the invention to any specific orientation. Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot region 13, arch region or mid-foot region 14 and heel region 15 generally are identified in FIG. 2. The upper 20 and sole assembly 30 each have a corresponding forefoot portion, arch region or mid-foot portion, and heel portion within these regions 13-15. However, it is to be understood that delineation of these regions may vary depending upon the configuration of the sole assembly and/or footwear.

Figure 2:
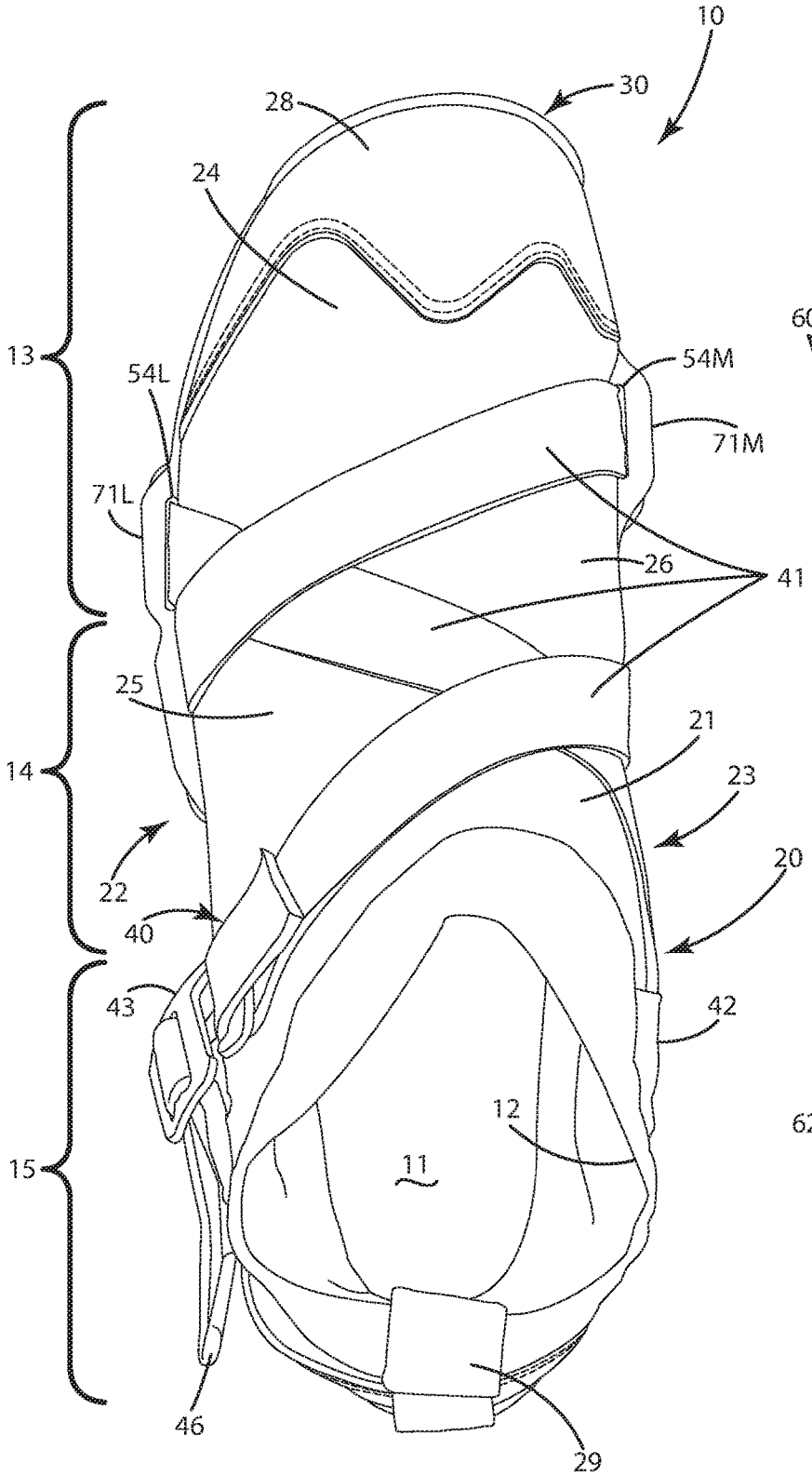
FIG. 2 is a top view of the footwear.
Figure 6:
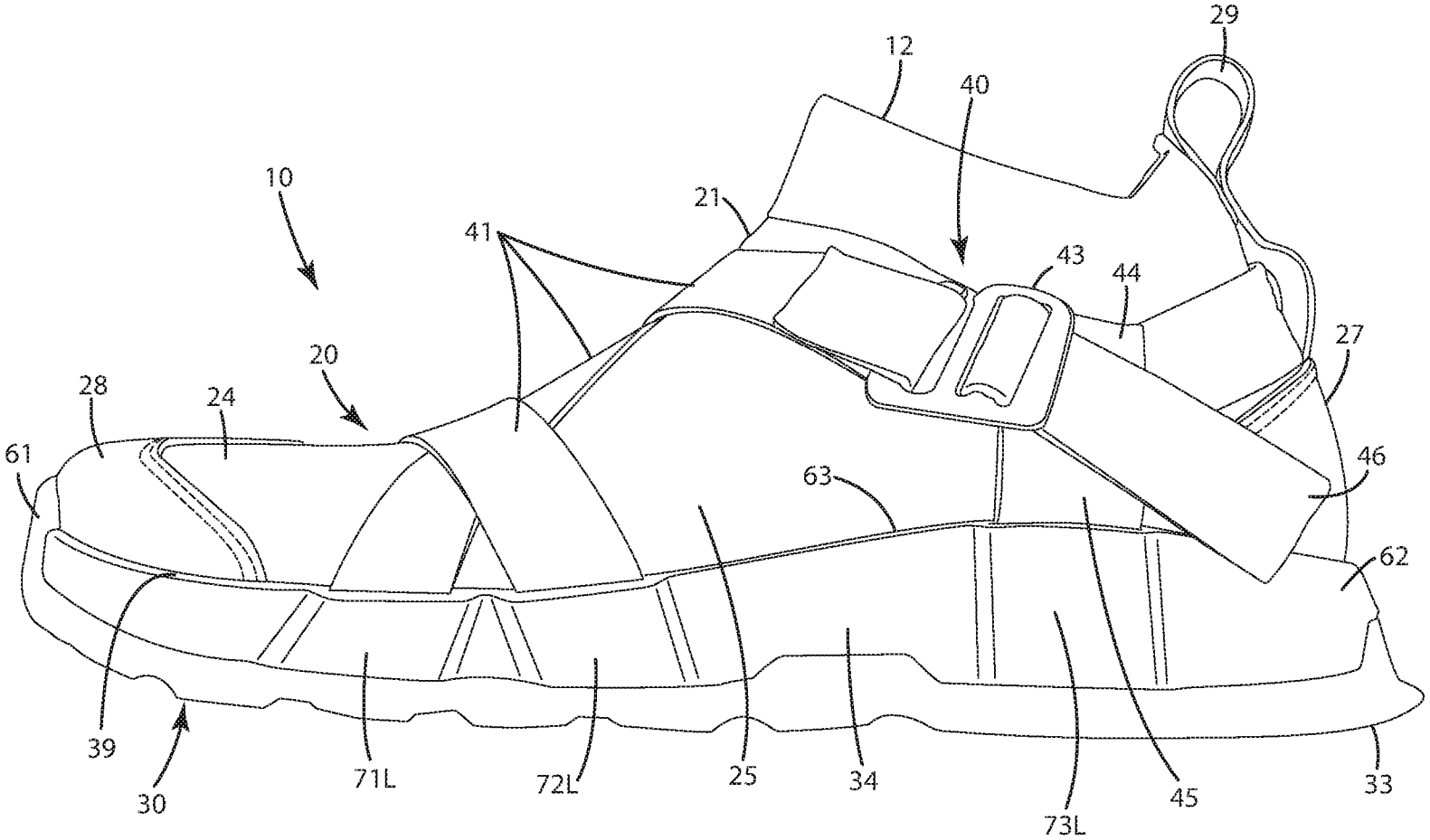
FIG. 6 is a lateral side view of the footwear.

Referring to FIGS. 1, 2, and 6, the upper 20 can include an exterior surface 21, a lateral side 22, and a medial side 23. Although the construction of the upper 20 may vary, the upper 20 of the illustrated embodiment generally includes a vamp 24 (or toe box) joined with one or more quarters or panels, including a lateral panel 25 along the lateral side 22, a medial panel 26 along the medial side 23, and a heel panel 27. The vamp 24 generally forms the forefoot portion of the upper 20 and the panels 25-27 form the arch and heel portions of the upper 20. The various pieces of the upper 20 may be manufactured from any combination of pieces of a wide range of materials, such as leather, synthetic leather, mesh, canvas, textile (e.g. woven, knit, bonded), fabric and molded components. In the embodiment illustrated herein, the vamp 24, lateral panel 25, medial panel 26, and heel panel 27 are contiguous and form a unitary knitted textile upper 20. In other embodiments, the upper 20 can be a multi-piece upper with the vamp 24, lateral panel 25, medial panel 26, and heel panel 27 sewn or otherwise joined together. The upper 20 may further include various trim, cushioning and reinforcing elements, such as, but not limited to, a toe bumper 28 provided to reinforce the vamp 24, a pull tab 29 provided to help pull the footwear 10 onto the wearer's foot, and/or a heel counter (not shown) be fitted into the heel region to reinforce the heel panel 27 and increase support.

Referring to FIGS. 3-5 and 7, the sole assembly 30 can include one or more different components, such as a base 31 defining a foot-shaped perimeter 32. The sole assembly 30 can further include an outsole 33 configured to include a ground contacting surface which itself may include multiple treads, lugs, spikes, cleats and/or other features designed to enhance traction between the footwear 10 and in underlying surface. Generally, regardless of which components are present, the sole assembly 30 can form the bottommost portion of the footwear 10.

Lateral and medial sidewalls 34, 35 can extend upward from the base 31. Specifically, the lateral sidewall 34 extends upward from the base 31, optionally adjacent the lateral panel 25 of the upper 20, and the medial sidewall 35 extends upward from the base 31, opposite the lateral sidewall 34, and optionally adjacent the medial panel 26 of the upper 20. The base 31, lateral sidewall 34, and medial sidewall 35 can form a downwardly-extending foot cradle 36 of the sole assembly 30. Specifically, the upper surface of the base 31 and the interior surfaces of the lateral and medial sidewalls 34, 35, opposite an exterior surface 37 of the sole assembly 30, can form the foot cradle 36.

As illustrated, the sole assembly 30 can include a heel wall 38 extending upward from the base 31, and can be joined with the lateral and medial sidewalls 34, 35 to closing a rearward portion of the foot cradle 36, i.e. at the heel portion of the sole assembly 30. The heel wall 38 can specifically extend upward from the base 31 adjacent the heel panel 27 of the upper 20, and can be contiguous with the lateral and medial sidewalls 34, 35.

Referring to FIGS. 1, 2, and 6, the strap system 40 can include one or more straps that wrap around the upper 20 and through a channel system in the sole assembly 30. As shown in the illustrated embodiment, a single strap 41 can be attached to a medial post 42 at one end, threaded through the channel system, and threaded through a buckle 43 that is attached to a lateral post 44. The medial and lateral posts 42, 44 can be defined by opposite ends of a single post strap 45.

The strap 41 can extend over the exterior surface 21 of the upper 20, transitioning from the lateral side 22 to the medial side 23 of the upper 20. The strap 41 can specifically extend over the forefoot and arch regions 13, 14 of the footwear 10, and around the heel region 15, and can further cross over itself in the forefoot and/or arch regions 13, 14. The strap 41 can further be free-floating relative to at least a portion of the exterior surface 21, and optionally can be cinched down to better secure the upper 20 to a wearer's foot. Specifically, the strap 41 is configured to be tightened to pull the upper 20 toward the base 31, and thereby secure a wearer's foot within the upper 20. In some cases, both the upper 20 and the strap 40 will secure the user's foot within the sole assembly 30, and optionally can keep the foot nested within the cradle 36. Further, with the strap 40 free-floating over the exterior 21, the strap 40 and parts of it can slide over various components of the upper 20 and the exterior 21, while the footwear 10 flexes and/or while the strap 40 is being tightened down. The strap 41 passes freely through the channel system so that pulling a free end 46 of the strap 41 tightens the entire strap 41, including around the forefoot, arch, and heel regions 13, 14, 15 of the footwear 10. The strap 41 extending up and over portions of the exterior surface 21 of the upper 20 can provide a unique appearance and ornamentation to the footwear 10. Further, with the strap 41 being free-floating over the upper 20 and under the footbed of the sole assembly 30, the strap 41 can encircle and dynamically tighten around the wearer's foot and/or ankle.

Figure 3:
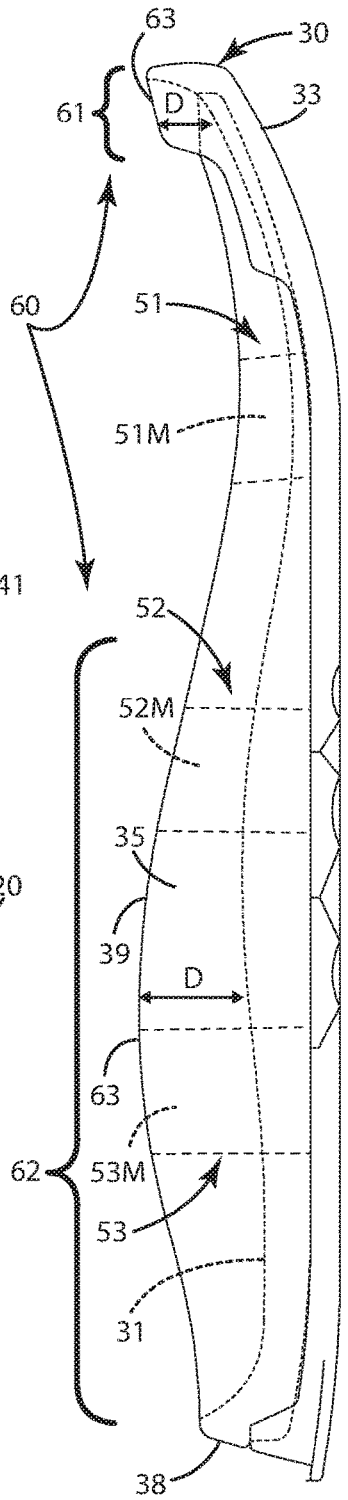
FIG. 3 is a lateral side view of the sole assembly illustrating strap channels of the integrated strap system defined by the sole assembly.
Figure 4:
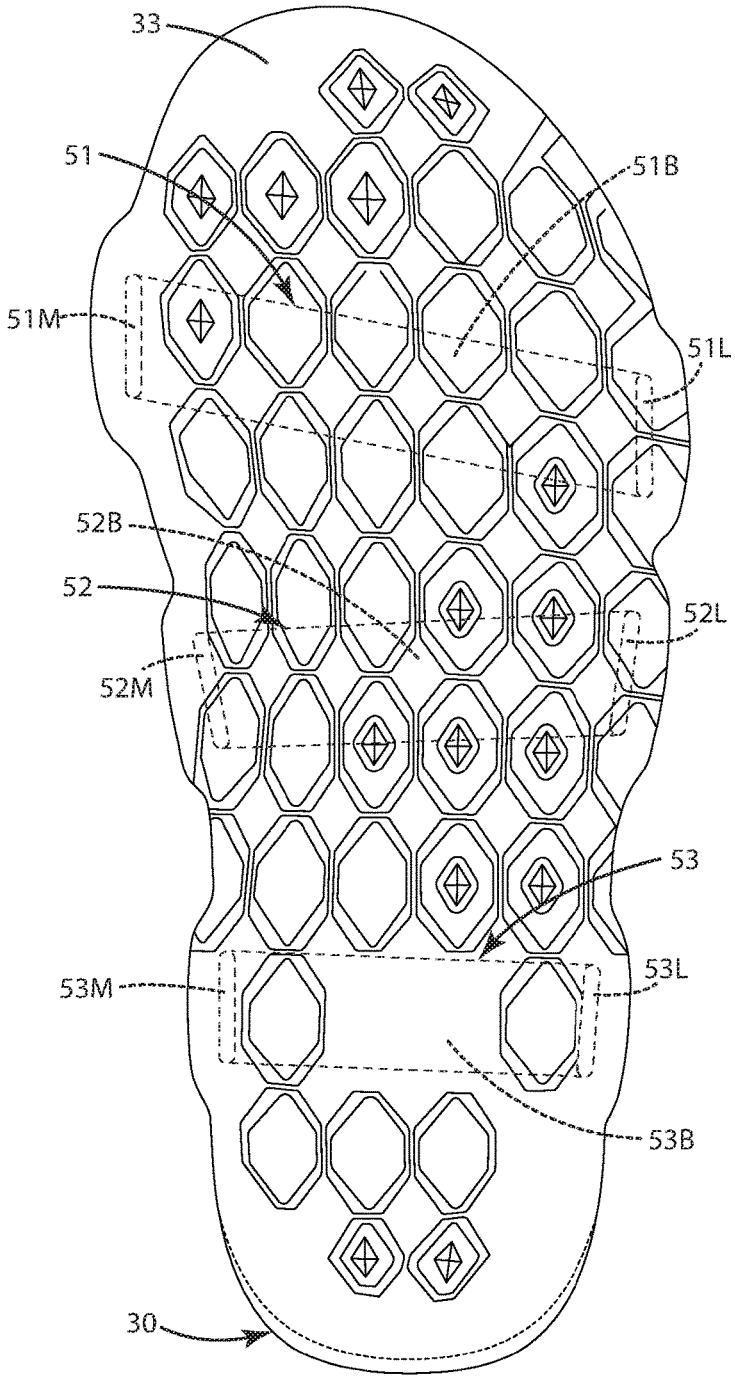
FIG. 4 is a bottom view of the sole assembly illustrating strap channels of the integrated strap system defined by the sole assembly.
Figure 5:
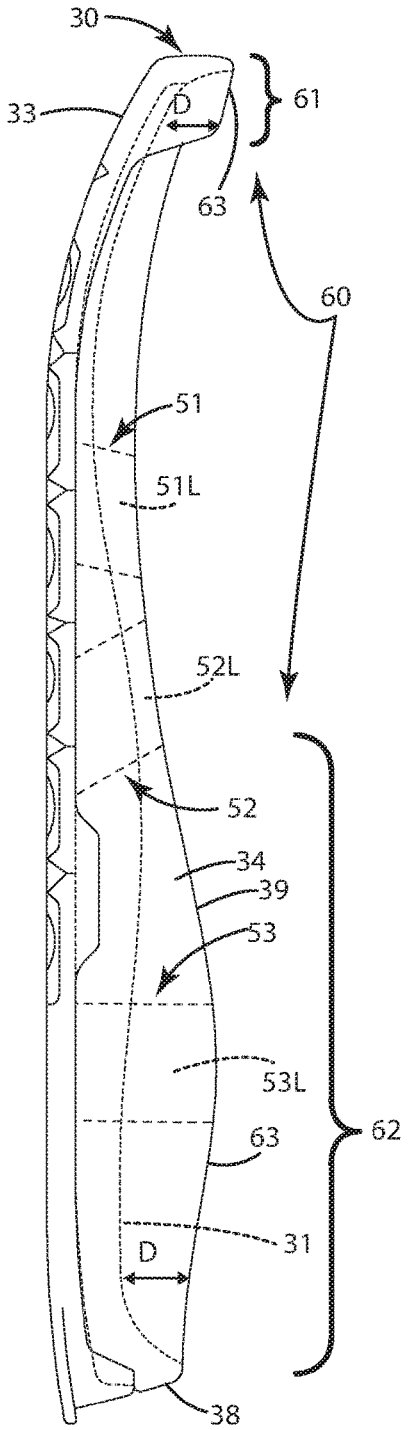
FIG. 5 is a medial side view of the sole assembly illustrating strap channels of the integrated strap system defined by the sole assembly.

Referring to FIGS. 3-5, as illustrated, the channel system comprises a plurality of strap channels 51, 52, 53, including a front or forefoot strap channel 51, a middle or arch strap channel 52, and a rear or heel strap channel 53. Portions of the strap 51, 52, 53 can be defined in any one or more of the base 31, lateral sidewall 34, and medial sidewall 35. In the illustrated embodiment, the front strap channel 51 includes a base strap channel 51B defined in the base 31, a lateral strap channel 51L defined in the lateral sidewall 34, and a medial strap channel 51M defined in the medial sidewall 35. The base strap channel 51B, lateral strap channel 51L, and the medial strap channel 51M form a contiguous strap channel 51 in which the strap 41 is slidably disposed in the forefoot region 13 of the footwear 10, and can be perpendicular or angled relative to the lateral direction across the width of the sole assembly 30.

The middle strap channel 52 includes a base strap channel 52B defined in the base 31, a lateral strap channel 52L defined in the lateral sidewall 34, and a medial strap channel 52M defined in the medial sidewall 35. The base strap channel 52B, lateral strap channel 52L, and the medial strap channel 52M form a contiguous strap channel 52 in which the strap 41 is slidably disposed in the forefoot region 13 and/or the arch region 14 of the footwear 10, rearwardly of the front strap channel 51, and can be perpendicular or angled relative to the lateral direction across the width of the sole assembly 30.

The rear strap channel 53 includes a base strap channel 53B defined in the base 31, a lateral strap channel 53L defined in the lateral sidewall 34, and a medial strap channel 53M defined in the medial sidewall 35. The base strap channel 53B, lateral strap channel 53L, and the medial strap channel 53M form a contiguous strap channel 53 disposed in the heel region 15 of the footwear 10, rearwardly of the middle strap channel 52, and can be generally perpendicular relative to the lateral direction across the width of the sole assembly 30. The rear strap channel 53 receives the post strap 45, with the medial and lateral posts 42, 44 protruding above the top side of the sole assembly 30 out of the medial and lateral strap channels 53M, 53L, respectively.

Figure 7:
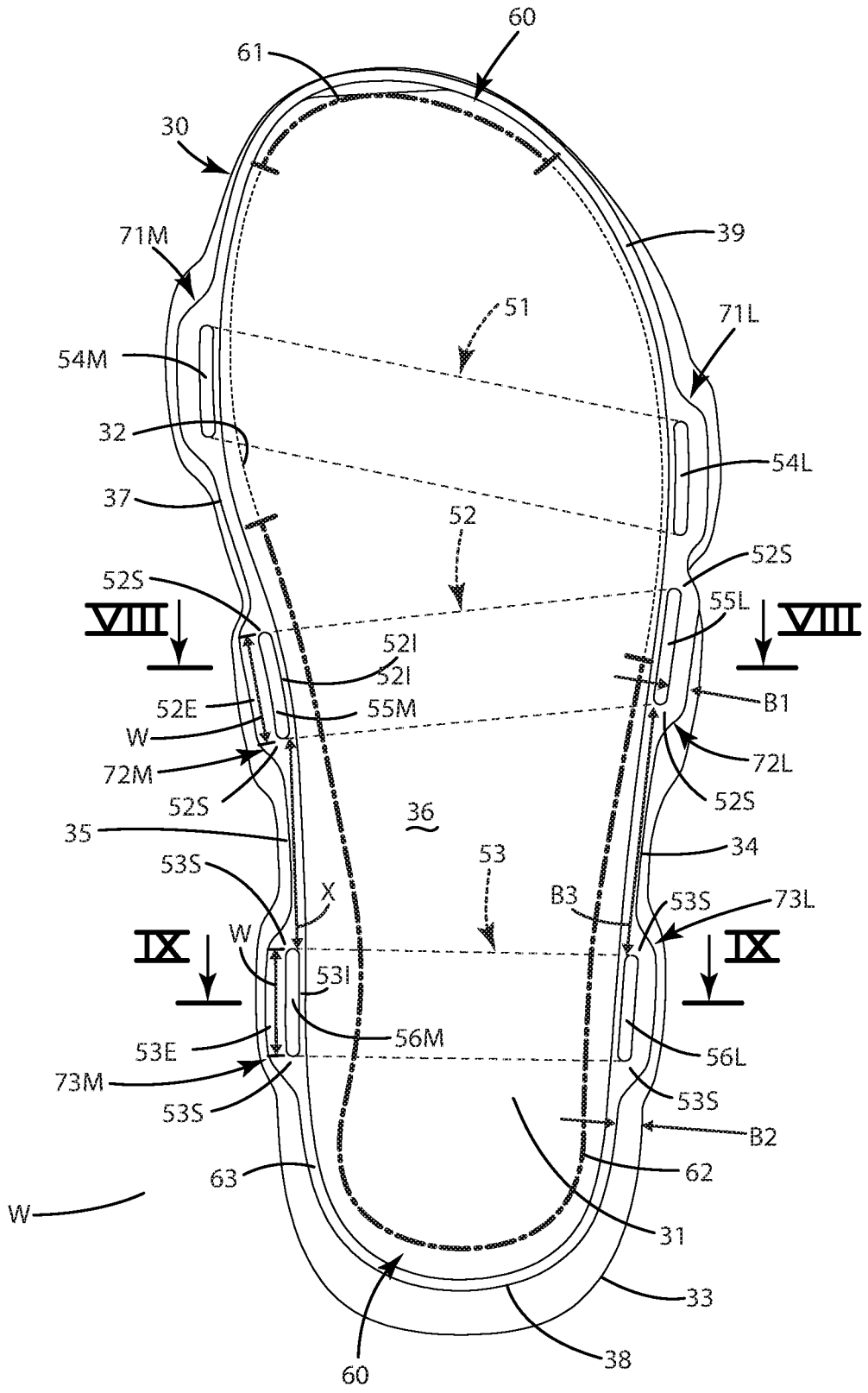
FIG. 7 is a top view of the sole assembly.

Referring additionally to FIG. 7, the channel system can include apertures or recesses in the sole assembly 30 through which the straps 41, 45 pass from a top side of the sole assembly 30 into the channels 51, 52, 53. In the illustrated embodiment, a lateral front aperture 54L is aligned with the lateral strap channel 51L of the front channel 51 and a medial front aperture 54M is aligned with the medial strap channel 51M of the front channel 51. A lateral front aperture 55L is aligned with the lateral strap channel 52L of the middle channel 52 and a medial front aperture 55M is aligned with the medial strap channel 52M of the middle channel 52. A lateral front aperture 56L is aligned with the lateral strap channel 53L of the rear channel 53 and a medial front aperture 56M is aligned with the medial strap channel 53M of the rear channel 53. The front and middle apertures 54M, 54L, 55M, 55L and channels 51, 52 generally work in conjunction to allow the strap 41 to enter the sole assembly 30 from one side, pass under the base 31 and exit the sole assembly 30 on the opposite side. The post strap 45 extends through the rear strap channel 53 and protrudes from apertures 56L, 56M.

The straps 41, 45 can be formed of a nylon, polymer, leather, canvas or a variety of other materials or combinations of materials. A variety of other configurations may also be used to form the straps 41, 45 and posts 42, 44. Optionally, the straps 41, 45 are in a web form, with a width at least 2, 3, 5, 10, or even 20 times the thickness of the strap 41, 45. Of course, the straps 41, 45 can be constructed from any elongated element, such as cord, rope, strands, and the like, depending on the application.

Referring to FIGS. 1, 3, 5, and 7, the footwear 10 can include a foxing-like band 60, also referred to as a foxing band 60 herein. The foxing band 60 secures the joint where the upper 20 and sole assembly 30 meet, and in the present embodiment can extend upward from the base 31 to define the foot cradle 36. The foxing band 60 can be a strip of material separate from the upper 20 and the sole assembly 30, or, as in the embodiment illustrated herein, can be molded with or otherwise part of the sole assembly 30.

The foxing band 60 can overlap the upper 20 and can substantially encircle the entire footwear 10 and/or the sole assembly 30 or parts of it. For example, the foxing band 60 can encircle at least 60% of the foot-shaped perimeter 32 of the sole assembly 30. In other embodiments, the foxing band 60 can encircle between 41 and 59% of the foot-shaped perimeter 32. For the illustrated embodiment, FIG. 7 indicates the extent of the foxing band 60 along the foot-shaped perimeter in dashed line, and is depicted as encircling at least 60% of the foot-shaped perimeter 32.

The foxing band 60 can be continuous or non-continuous about the footwear 10 and/or around the foot-shaped perimeter 32. In the illustrated embodiment, the foxing band 60 includes a first foxing band 61 generally in the forefoot region 13 and extending around the toe of the footwear 10, and a second foxing band 62 generally in the arch and heel regions 14, 15, and extending from the lateral side 22 to the medial side 23, around the heel of the footwear 10. Specifically, the first foxing band 61 overlaps portions of the vamp 24 and/or toe bumper 28, and the second foxing band 62 overlaps portions of the lateral, medial, and heel panels 25-27. The second foxing band 62 further defines the foot cradle 36.

Together, the cumulative amount by which the first and second foxing bands 61, 62 encircle the foot-shaped perimeter can be at least 60%. In other embodiments, the cumulative amount by which the first and second foxing bands 61, 62 encircle the foot-shaped perimeter can be between 41 and 59%.

The foxing band 60 can terminate at an upper rim 63 disposed a distance D above the base 31. The distance D can be measured vertically starting from where the material of the upper 20 turns upward from a horizontal plane to a vertical plane. In the illustrated embodiment, the material of the upper 20 is joined with the base 31, and so turns upward from a horizontal plane to a vertical plane at the base 31. The distance D can be measured as the vertical distance between the base 31 and the upper rim 63. As shown in FIGS. 3 and 5, the distance D can vary about the foot-shaped perimeter 32, but can be, at a minimum, at least ¼ inch, such that the upper rim 63 is disposed at least ¼ inch from the base 31 to accordingly provide an overlap of the upper 20 of at least ¼ inch to establish the foxing band 60, i.e. for at least 60% of the foot-shaped perimeter 32. Optionally, the foxing band 60 can terminate at least ⅜ inch from the base 31 to accordingly provide an overlap of the upper 20 of at least ⅜ inch to establish a different height of the foxing band 60, i.e. for at least 60% of the foot-shaped perimeter 32.

The distance D for the foxing band 60 can depend on the size of the footwear 10. For example, the distance D can be at least ¼ inch for adult sizes, including footwear in American men's, youths, and boys sizes 11.5 and larger, and American women's and misses sizes 12.5 and larger. The distance D can be at least 3/16 inch for child sizes, including American children's size 8.5 up to boys size 11 and girls size 12, for the entire extent of the foxing band 60, i.e. for at least 60% of the foot-shaped perimeter 32. The distance D can be at least ⅛ inch for American infant sizes, including infant sizes 0 through 8, for the entire extent of the foxing band 60, i.e. for at least 60% of the foot-shaped perimeter 32.

For the non-continuous foxing band 60 illustrated herein, the distance D is applicable to both the first and second foxing bands 61, 62, such that FIGS. 3 and 5 show some exemplary locations in which the distance D can be measured, although it is understood that, at a location along either the first or second foxing band 61, 62, the distance D, i.e. the distance D between the base 31 and the rim 63, is the minimum distance required for a foxing band as discussed above.

In the illustrated embodiment, the lateral sidewall 34, medial sidewall 35, and heel wall 38 can form at least a portion of the foxing band 60. As shown herein, the lateral sidewall 34, medial sidewall 35, and heel wall 38 can terminate at the upper rim 63, which can form a portion of and be contiguous with an uppermost rim 39 of the sole assembly 30. Accordingly, each of the lateral sidewall 34, medial sidewall 35, and heel wall 38 terminate the distance D above the base 31, including at least ¼ inch from the base 31, or at least ⅜ inch from the base 31, to provide an overlap of the upper 20. Specifically, the lateral sidewall 34 extends adjacent and overlaps the lateral panel 25 of the upper 20, the medial sidewall 35 extends adjacent and overlaps the medial panel 26 of the upper 20, and the heel wall 38 extends adjacent and overlaps the heel panel 27 of the upper 20.

In a further embodiment, the foxing band 60 can define the lateral and medial strap channels 53L, 53M for at least the rear strap channel 53. The foxing band 60 can define the medial strap channel 52M for the middle strap channel 52, and a portion of the lateral strap channel 52L. Optionally, the foxing band 60 can define any combination of the lateral and medial strap channels 51L, 51M, 52L, 52M, 53L, 53M for each strap channel 51, 52, 53.

Figure 9:
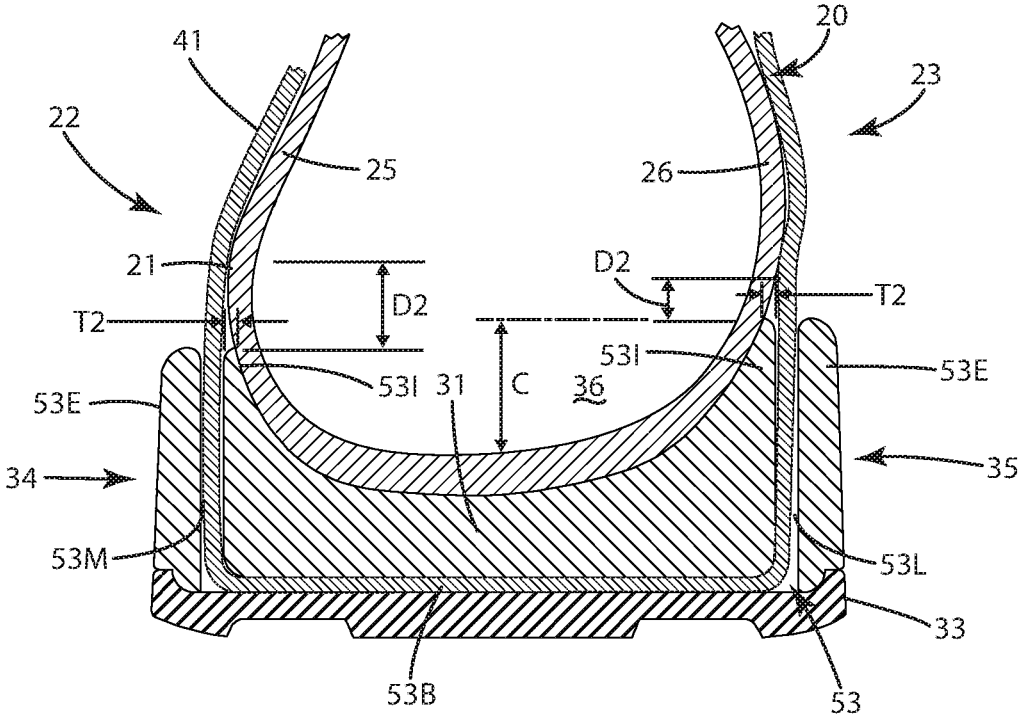
FIG. 9 is a section view of the sole assembly showing a strap channel taken along line IX-IX of FIG. 7.

Referring to FIG. 9, the foot cradle 36 cooperatively formed by the foxing band 60 and/or walls 34, 35 can form a deep cradle for the user's foot, which can provide a comfortable area within which the foot is solidly planted. The foot cradle 36 can have a cradle depth C defined as the maximum distance, measured vertically, between the base 31 and the rim 63 of the foxing band 60 on either the medial or lateral side. As shown in FIG. 9, the cradle depth C is measured between the base 31 and the rim of the medial sidewall 35, and can be optionally at least 20 mm, further optionally at least 25 mm, yet further optionally at least 30 mm, still further optionally at least 40 mm, and yet further optionally at least 50 mm or more for adult sizes, including footwear in American men's, youths, and boys sizes 11.5 and larger, and American women's and misses sizes 12.5 and larger. Optionally, the foot cradle 36 can be bordered by one or more of the strap channels, which can provide extra lateral stability to the footwear 10. In the illustrated embodiment, the rear strap channel 53 can extend under the foot cradle 36 and also upwardly adjacent the foot cradle 36 on the lateral and medial sides 22, 23 of the upper 20.

Figure 8:
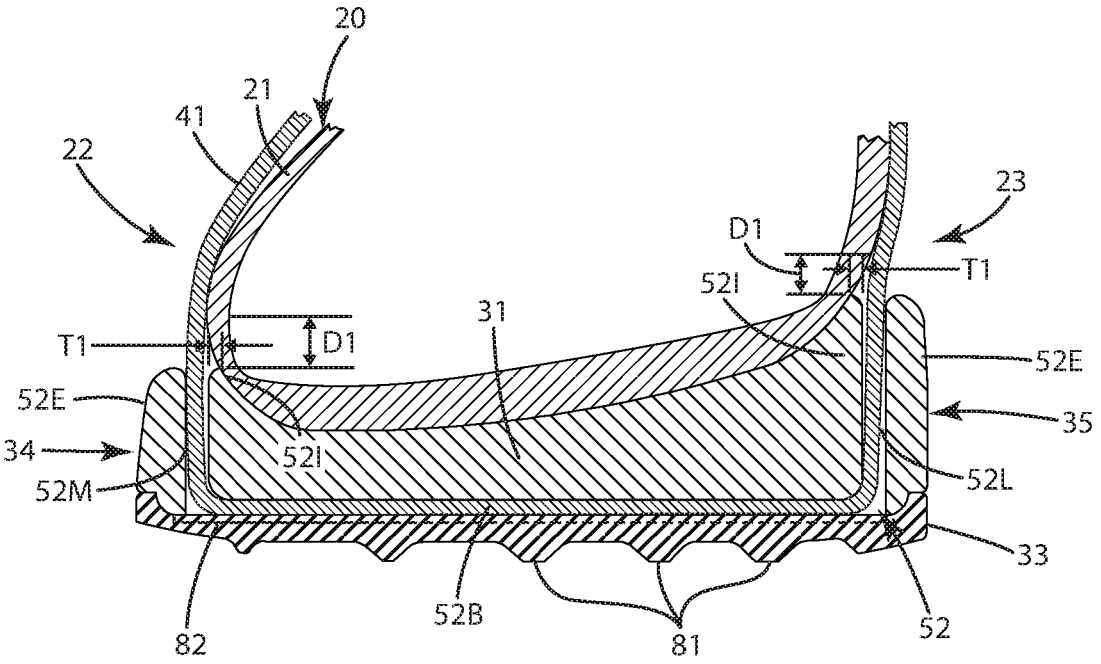
FIG. 8 is a section view of the sole assembly showing a strap channel taken along line VIII-VIII of FIG. 7.

Referring to FIGS. 8-9, in some embodiments, the strap 41 can be held away from the upper 20 near the uppermost rim 39 of the sole assembly 30 to promote movement and prevent strap pinch. As shown herein, the foxing band 60 or other walls 34, 35 of the sole assembly 30, can include an interior channel wall which spaces the strap 41 away from the exterior surface 21. FIG. 8 illustrates this for the middle strap channel 52. The lateral and medial sidewalls 34, 35 include interior channel walls 52I and exterior channel walls 52E, which are spaced apart to define the lateral and medial strap channels 52L, 52M of the middle strap channel 52. The interior channel walls 52I can directly engage and overlap a lower portion of the exterior surface 21 of the upper 20. The strap 41 extends from the lateral and medial strap channels 52L, 52M upward along the exterior surface 21, on the lateral and medial sides 22, 23, respectively.

The interior channel walls 52I have an interior wall thickness T1 at the rim 63, such that the interior channel walls 52I hold the strap 41 away from the exterior surface 21 by at least the interior wall thickness T1 for a distance D1, which is defined as the vertical distance from the rim 63 to the point of contact between the strap 41 and the exterior surface 21 of the upper 20. The strap 41, emerging from the apertures 55L, 55M, can contact the exterior surface 21 beyond the distance D1. In the illustrated embodiment, the thickness T1 is optionally at least 1.0 mm, further optionally at least 1.5 mm, yet further optionally at least 2.0 mm, still further optionally at least 2.5 mm, or even further optionally at least 3.0 mm for both interior channel walls 52I. It is noted however that the thickness T1 for the lateral and medial interior channel walls 52I can be different in other embodiments. Likewise, the distance D1 for the lateral and medial sides can be the same or different.

FIG. 9 illustrates this for the rear strap channel 53. The lateral and medial sidewalls 34, 35 include interior channel walls 53I and exterior channel walls 53E, which are spaced apart to define the lateral and medial strap channels 53L, 53M of the rear strap channel 53. The interior channel walls 53I directly engage and overlap a lower portion of the exterior surface 21 of the upper 20. The strap 41 extends from the lateral and medial strap channels 53L, 53M upward along the exterior surface 21, on the lateral and medial sides 22, 23, respectively.

The interior channel walls 53I have an interior wall thickness T2 at the rim 63, such that the interior channel walls 53I hold the strap 41 away from the exterior surface 21 by at least the interior wall thickness T2 for a distance D2, which is defined as the vertical distance from the rim 63 to the point of contact between the strap 41 and the exterior surface 21 of the upper 20. The strap 41, emerging from the apertures 56L, 56M, contacts the exterior surface 21 beyond the distance D2. In the illustrated embodiment, the thickness T2 is optionally at least 1.0 mm, further optionally at least 1.5 mm, yet further optionally at least 2.0 mm, still further optionally at least 2.5 mm, or even further optionally at least 3.0 mm for both interior channel walls 53I. It is noted however that the thickness T2 for the lateral and medial interior channel walls 53I can be different in other embodiments. Likewise, the distance D2 for the lateral and medial sides can be the same or different.

Referring to FIG. 7, the medial strap channels 52M, 53M for the middle and rear strap channels 52, 53 can each having a predetermined channel width W and can be separated from each other by a predetermined channel distance X. In some embodiments of the footwear 10, the ratio of the channel distance X to the channel width W is optionally greater than 2:1, inclusive, further optionally greater than 1.5:1, inclusive, further optionally greater than 2.5:1, inclusive, and still further optionally greater than 3:1, inclusive. In the illustrated embodiment, the channel width W is optionally at least 20 mm, further optionally at least 25 mm, and still further optionally at least 30 mm for both medial strap channels 52M, 53M. It is noted however that the channel width W for the middle and rear medial strap channels 52M, 53M can be different in other embodiments.

In some embodiments, portions of the strap channels 51, 52, 53 can form channel boxes 71L, 72L, 73L, 71M, 72M, 73M that protrude from the exterior surface 37 of the sole assembly 30 to channel the straps 41, 45, particularly for one or more the lateral and medial strap channels 51L, 51M, 52L, 52M, 53L, 53M. By using the protruding channel boxes rather than an extremely thick sidewall around the entire perimeter of the sole assembly 30, the weight of the sole assembly 30 can be reduced.

In the illustrated embodiment, the front, middle, and rear channel boxes 71L, 72L, 73L protrude outward from the lateral sidewall 34 on the sole exterior surface 37. The front channel box 71L can protrude outward from the sole exterior surface 37 below the vamp 24 on the lateral side 22 of the upper 20, and defines the lateral strap channel 51L of the front strap channel 51. The middle channel box 72L can protrude outward from the sole exterior surface 37 below the lateral panel 25 on the lateral side 22 of the upper 20, and defines the lateral strap channel 52L of the middle strap channel 52, optionally along with the lateral sidewall 34. The rear channel box 73L can protrude outward from the sole exterior surface 37 below the lateral panel 25 on the lateral side 22 of the upper 20, and can be rearward of the middle channel box 72L. The rear channel box 73L defines the lateral strap channel 53L of the rear strap channel 53, optionally along with the lateral sidewall 34.

The front, middle, and rear channel boxes 71M, 72M, 73M can protrude outward from the medial sidewall 35 on the sole exterior surface 37. The front channel box 71M can protrude outward from the sole exterior surface 37 below the vamp 24 on the medial side 23 of the upper 20, and defines the medial strap channel 51M of the front strap channel 51. The middle channel box 72M can protrude outward from the sole exterior surface 37 below the medial panel 25 on the medial side 23 of the upper 20, and defines the medial strap channel 52M of the middle strap channel 52, optionally along with the medial sidewall 35. The rear channel box 73M can protrude outward from the sole exterior surface 37 below the medial panel 26 on the medial side 23 of the upper 20, and can be rearward of the middle channel box 72M. The rear channel box 73M defines the medial strap channel 53M of the rear strap channel 53, optionally along with the medial sidewall 35.

The middle and rear channel boxes 72L, 72M, 73L, 73M can be defined by the interior and exterior channel walls 52I, 52E, 53I, 53E described above, as well as side channel walls 52S, 53S which join at least the exterior channel walls 52E, 53E with the exterior surface 37. Similar channel walls can also define the front channel boxes 71L, 71M.

In at least some embodiments, the middle lateral channel box 72L can protrude outward from the lateral sidewall 34 a first box distance B1 on the sole exterior surface 37. The rear lateral channel box 73L protrudes outward from the lateral sidewall 34 a second box distance B2 on the sole exterior surface 37. The middle and rear lateral channel boxes 72L, 73L are further separated from one another by a predetermined third box distance B3. In some embodiments, the ratio of the third box distance B3 to the first box distance B1 and/or the second box distance B2 is optionally greater than 2:1, inclusive, further optionally greater than 4:1, inclusive, further optionally greater than 8:1, inclusive, and still further optionally greater than 10:1, inclusive. In the illustrated embodiment, the first and second box distances B1, B2 is optionally at least 5.0 mm. Similar box distances can be present for the other channel boxes 71L, 71M, 72M, 73M. It is noted however that the box distance for individual channel boxes can be different in other embodiments.

With reference to FIGS. 4 and 8, in some embodiments, the outsole 33 can have a plurality of treads 81, or other features designed to enhance traction between the footwear 10 and in underlying surface, joined below the base 31. The base strap channels 51B, 52B, 53B can be covered by the outsole 33. Optionally, the sole assembly 30 can include a rock plate 82 adjacent the outsole 33 in predetermined areas. The rock plate 82 can render the sole assembly 30 more rigid, and can prevent the wearer from feeling sharp rocks or objects underfoot.

In at least some embodiments, the footwear 10 and can fall under Heading/Subheading 6404.19.90 in the Harmonized Tariff Schedule of the United States (2018) Revision 13, and further described in What Every Member of the Trade Community Should Know About: Footwear, an informed compliance publication from U.S. Customs and Border Protection, dated April 2012, both of which are incorporated herein by reference in their entirety.

The various components and features of the embodiments herein, for example, the upper 20, sole assembly 30 or other footwear portions, can take on a variety of aesthetic forms, shapes and sizes. Although a particular component or feature can have a function, that feature can be expressed in different aesthetic manners to form an artistic design and/or purely ornamental design.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An article of footwear comprising:

an upper including an exterior surface, a lateral side, and a medial side, and comprising a vamp joined with a lateral panel, a medial panel, and a heel panel;

a sole assembly joined with the upper, the sole assembly comprising:

a base defining a foot-shaped perimeter and a first base strap channel;

a lateral sidewall extending upward from an upper surface of the base adjacent the lateral panel of the upper, the lateral sidewall defining a first lateral strap channel; and a medial sidewall opposite the lateral sidewall extending upward from the upper surface of the base adjacent the medial panel of the upper, the medial sidewall defining a first medial strap channel;

the first base strap channel, the first lateral strap channel, and the first medial strap channel, forming a contiguous strap channel;

the upper surface of the base, lateral sidewall, and medial sidewall forming a downwardly-extending foot cradle below an uppermost rim of the sole assembly; and a strap slidably disposed in the contiguous strap channel, the strap extending upward and over the exterior surface of the upper and transitioning from the lateral side to the medial side of the upper;

wherein the strap is free-floating relative to at least a portion of the exterior surface;

wherein the strap is configured to be tightened to pull the upper toward the base and thereby secure a wearer's foot within the upper; and wherein the lateral sidewall and medial sidewall form at least a portion of a foxing band that encircles at least 60% of the foot-shaped perimeter, the foxing band securing a joint where the upper and sole assembly meet and overlapping the exterior surface of the upper by a distance of at least ¼ inch.

2. The article of footwear of claim 1, comprising a heel wall extending upward from the upper surface of the base adjacent the heel panel of the upper, the heel wall joined with the lateral and medial sidewalls and closing a rearward portion of the downwardly-extending foot cradle.

3. The article of footwear of claim 2, wherein the lateral sidewall, the medial sidewall and the heel wall terminate at the uppermost rim of the sole assembly, and wherein the uppermost rim is disposed a distance of at least ¼ inch above the base around at least 60% of the foot-shaped perimeter.

4. The article of footwear of claim 3, wherein the distance is at least ⅜ inch.

5. The article of footwear of claim 3, wherein the lateral sidewall extends adjacent and overlaps the lateral panel for the distance, the medial sidewall extends adjacent and overlaps the medial panel for the distance, and the heel wall extends adjacent and overlaps the heel panel for the distance.

6. The article of footwear of claim 5, wherein the vamp, lateral panel, medial panel and heel panel are contiguous and the upper comprises a unitary knitted textile upper.

7. The article of footwear of claim 1, wherein the sole assembly includes an outsole having a plurality of treads joined below the base, and the first base strap channel is covered by the outsole.

8. The article of footwear of claim 1, wherein the lateral sidewall includes an exterior channel wall and an interior channel wall that directly engages and overlaps a lower portion of the exterior surface of the upper, wherein the interior channel wall has an interior wall thickness; and wherein the strap extends from the first lateral strap channel upward along the exterior surface, the interior channel wall holds the strap away from the exterior surface by at least the interior wall thickness for a first distance, and the strap contacts the exterior surface beyond the first distance.

9. The article of footwear of claim 1, comprising a heel wall extending upward from the upper surface of the base adjacent the heel panel of the upper, wherein the heel wall is contiguous with the lateral and medial sidewalls and forms at least a portion of the foxing band.

10. The article of footwear of claim 1, comprising:

a sole exterior surface below the lateral panel on the lateral side; and a first lateral channel box on the sole exterior surface that protrudes outward from the lateral sidewall by a first box distance;

wherein the first lateral strap channel is defined by the first lateral channel box.

11. The article of footwear of claim 10, comprising:

a second lateral channel box on the sole exterior surface that protrudes outward from the lateral sidewall by a second box distance, the second lateral channel box being separated from the first lateral channel box by a third box distance;

wherein a second lateral strap channel is defined by the second lateral channel box.

12. The article of footwear of claim 11, wherein the ratio of the third box distance to the first box distance is greater than 2:1, and the ratio of the third box distance to the second box distance is greater than 2:1.

13. The article of footwear of claim 10, wherein the first medial strap channel has a first channel width, the medial sidewall defines a second medial strap channel having a second channel width, and the first medial strap channel is separated from the second medial strap channel by a channel distance, wherein the ratio of the channel distance to the first channel width is greater than 2:1 and the ratio of the channel distance to the second channel width is greater than 2:1.

14. The article of footwear of claim 1, wherein the foxing band is non-continuous about the foot-shaped perimeter and comprises:

a first foxing band extending around a toe of the footwear and overlapping a portion of the vamp of the upper; and a second foxing band extending around a heel of the footwear and overlapping portions of the lateral panel, the medial panel, and the heel panel of the upper.

15. An article of footwear comprising:

an upper including an exterior surface, a lateral side, and a medial side;

a sole assembly joined with the upper, the sole assembly comprising:

a base defining a foot-shaped perimeter;

a lateral sidewall extending upward from an upper surface of the base, the lateral sidewall defining a lateral strap channel;

a medial sidewall opposite the lateral sidewall extending upward from the upper surface of the base, the medial sidewall defining a medial strap channel; and a channel box protruding outward from one of the lateral sidewall and the medial sidewall, wherein the channel box defines one of the lateral strap channel and the medial strap channel;

the upper surface of the base, lateral sidewall, and medial sidewall forming a downwardly-extending foot cradle below an uppermost rim of the sole assembly;

a foxing band overlapping the exterior surface of the upper and encircling at least 60% of the foot-shaped perimeter, wherein the lateral sidewall and medial sidewall form at least a portion of the foxing band; and a strap slidably disposed in the lateral strap channel and the medial strap channel, the strap extending over the exterior surface of the upper and transitioning from the lateral side to the medial side of the upper, wherein the strap is free-floating relative to at least a portion of the exterior surface.

16. The article of footwear of claim 15, wherein the lateral sidewall includes an interior channel wall having an interior wall thickness, wherein the strap extends from the lateral strap channel upward along the exterior surface and is disposed at least the interior wall thickness away from the exterior surface for a distance, and wherein the strap contacts the exterior surface beyond the distance.

17. The article of footwear of claim 15, comprising a heel wall extending upward from the upper surface of the base and forming a portion of the foxing band, wherein the heel wall, the lateral sidewall and the medial sidewall terminate at an upper rim disposed a distance above the base.

18. The article of footwear of claim 17, wherein the distance is at least ¼ inch.

19. An article of footwear comprising:

an upper including an exterior surface, a lateral side, and a medial side;

a sole assembly joined with the upper, the sole assembly comprising:

a base defining a foot-shaped perimeter;

a foxing band extending upward from the base to define a foot cradle, the foxing band overlapping the exterior surface of the upper and securing a joint where the upper and sole assembly meet, the foxing band encircling at least 60% of the foot-shaped perimeter and terminating at an upper rim disposed a first distance of at least ¼ inch from the base, the foxing band defining a medial strap channel and a lateral strap channel; and a strap slidably disposed in the lateral strap channel and the medial strap channel, the strap extending under the base of the sole assembly and over the exterior surface of the upper, and transitioning from the lateral side to the medial side of the upper;

wherein the strap is free-floating relative to at least a portion of the exterior surface;

wherein the foxing band includes an interior channel wall having an interior wall thickness, wherein the strap extends from at least one of the medial strap channel or the lateral strap channel upward along the exterior surface, wherein the strap is disposed at least the interior wall thickness away from the exterior surface for a second distance, and wherein the strap contacts the exterior surface beyond the second distance.

20. An article of footwear comprising:

an upper including an exterior surface, a lateral side, and a medial side;

a sole assembly joined with the upper, the sole assembly comprising:

a base defining a foot-shaped perimeter;

a foxing band extending upward from the base to define a foot cradle, the foxing band overlapping the exterior surface of the upper and securing a joint where the upper and sole assembly meet, the foxing band encircling at least 60% of the foot-shaped perimeter and terminating at an upper rim disposed a first distance of at least ¼ inch from the base, the foxing band defining a medial strap channel and a lateral strap channel; and a strap slidably disposed in the lateral strap channel and the medial strap channel, the strap extending under the base of the sole assembly and over the exterior surface of the upper, and transitioning from the lateral side to the medial side of the upper;

wherein the strap is free-floating relative to at least a portion of the exterior surface;

wherein the sole assembly comprises:

a lateral sidewall;

a medial sidewall opposite the lateral sidewall; and a channel box protruding outward from one of the lateral sidewall and the medial sidewall, wherein the channel box defines one of the medial strap channel and the lateral strap channel.

* * * * *